United States Patent [19]

Waigand

[11] Patent Number: 4,849,597

[45] Date of Patent: Jul. 18, 1989

[54] OVEN CONTROLLER WITH SAFETY RESET OF TIMER

[75] Inventor: Helmut Waigand, St. Georgen, Fed. Rep. of Germany

[73] Assignee: Bosch-Siemens Hausgeräte GmbH, Munich, Fed. Rep. of Germany

[21] Appl. No.: 169,083

[22] Filed: Mar. 16, 1988

Related U.S. Application Data

[63] Continuation of Ser. No. 893,796, Aug. 6, 1986, abandoned.

[30] Foreign Application Priority Data

Aug. 6, 1985 [DE] Fed. Rep. of Germany ..... 3528229

[51] Int. Cl.[4] ..... H05B 1/02

[52] U.S. Cl. ..... 219/414; 219/492; 219/506; 99/337

[58] Field of Search ..... 219/413, 414, 483, 489, 219/492, 506; 99/325, 337

[56] References Cited

U.S. PATENT DOCUMENTS

| | | | |
|---|---|---|---|
| 3,974,472 | 8/1976 | Gould, Jr. | 219/506 |
| 4,345,145 | 8/1982 | Norwood | 219/492 |
| 4,431,907 | 2/1984 | Barnett | 219/449 |

*Primary Examiner*—A. D. Pellinen
*Assistant Examiner*—H. L. Williams
*Attorney, Agent, or Firm*—Herbert L. Lerner; Laurence A. Greenberg

[57] ABSTRACT

A device for controlling electrical consuming devices in ovens includes a function control device which can be adjusted for the control of function cycles, an evaluation circuit, a manually operated function selector switch for adjusting the function control device through a binary code connection, special manually operated input elements directly assigned to the function control device also operating for adjusting the function control device, the evaluation circuit being disposed in the function selector device for receiving the binary signals provided by the function selector switch which, upon the change of at least one of the binary codes, causes a resetting criterion for the function commands entered through the input elements.

8 Claims, 2 Drawing Sheets

FIG. 1
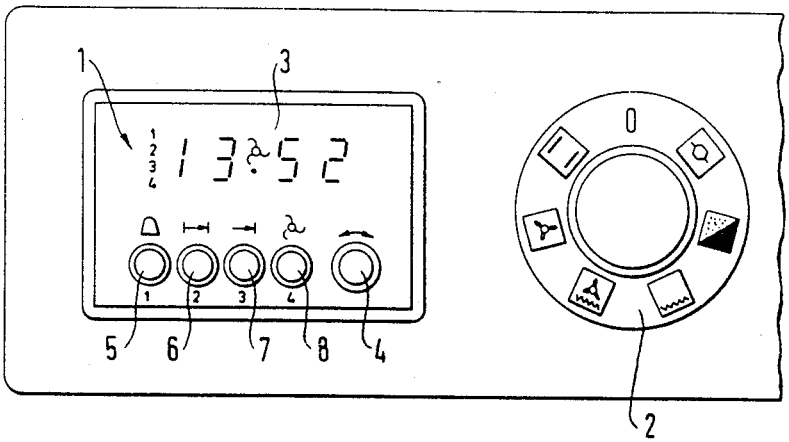
FIG. 2
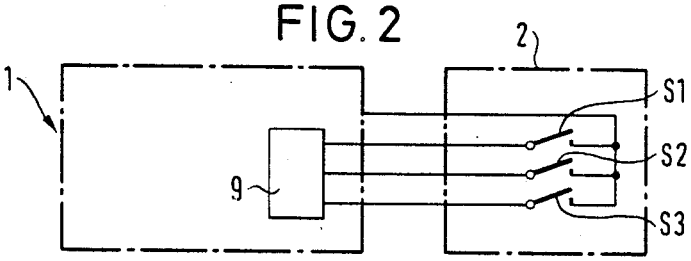
FIG. 3
| SETTING | OPERATION | S1 | S2 | S3 |
|---|---|---|---|---|
| 0 | 0-SETTING | 0 | 0 | 1 |
| | ROASTING AUTOMATIC | 1 | 1 | 0 |
| | SELF-CLEANING | 1 | 0 | 0 |
| | FLAT GRILL | 0 | 0 | 0 |
| | AIR GRILL | 0 | 1 | 0 |
| | CIRCULATING AIR | 0 | 0 | 0 |
| | TOP / BOTTOM HEAT | 0 | 1 | 0 |

OVEN CONTROLLER WITH SAFETY RESET OF TIMER

This application is a continuation of application Ser. No. 893,796 filed Aug. 6, 1986, now abandoned.

The invention relates to a device for controlling electrical consuming devices in ovens, including a function control device which can be adjusted for the control of function cycles by means of a manually operated function selector switch through a binary code connection and additionally by means of special manually operated input elements.

Devices of this kind are known to be applied in ranges for fully automatic and semi-automatic control of function cycles. A simple form of this application is the simple time limiting of a cooking, roasting or baking process through a timing circuit, wherein the adjustment of the heating power takes place through individual switching elements, which may be a temperature selector switch or an energy selector switch, i.e. similar to the case wherein the oven is started without the application of the automatic time switch. This means that the automatic time switch, in addition to the input elements for the switch-on time, switch-off time/or operating time, has to be equipped with an input element through which selected functions and function modes of the oven can be converted from purely manual operation to time controlled operation.

Additionally, such time control devices for ovens are supplemented with a mode-of-operation selector, so that the time switch device can be assigned to different function cycles. It is possible for the function selector switch, whether it is a row of keys, a slide-type switch or a rotary switch, to be either selectively or non-selectively readjusted. This leads to automatically assigning the turned-on time switch to new operating conditions. If these new operating conditions are more severe than the operating function actually assigned to the automatic time switch, quite serious disturbances can occur and dangerous situations can result.

It is accordingly an object of the invention to provide a device for selectively controlling electrical heating devices in baking ovens by means of a function control device, which overcomes the hereinafore-mentioned disadvantages of the heretofore-known devices of this general type and which, in the above-mentioned field of use, provides functional security which is as high as possible and avoids danger sources to the furthest extent possible. The additional cost is also to be as low as possible.

With the foregoing and other objects in view there is provided, in accordance with the invention, a device for controlling electrical consuming devices in ovens, which include a function control device adjustable for the control of function cycles by means of a manually operated function selector switch through a binary code connection and additionally by means of special manually operated input elements, an evaluation circuit disposed in the function control device into which the binary signals provided by the function selector switch are fed, and which, upon the change of at least one of the binary signal values, causes a resetting criterion for the function commands entered through the input elements directly assigned to the function control device.

When the function selector switch is changed, a signal is sent to the function control device, the signal being a resetting criterion for the function commands which may be entered directly through the input elements assigned to the function control device. The device in accordance with the invention saves additional costs since as the already existing control commands, which act upon the function control device, sent by the function selector switch for the performance of certain function cycles, are used to signal a change in the function assignment and to cause the function commands which may have been originally entered directly through the input elements assigned to the function control device. These function commands are usually time control commands which activate the assigned areas of the oven for certain time spans.

The function selector switch may be able to additionally perform further function cycles, like the application of automatic roasting or self-cleaning. In accordance with another feature of the invention, the rotary switch is a function selector switch. The various adjustment positions thereof each correspond to one function assignment, whereby for security reasons a position defined as a zero position is provided.

In accordance with an additional feature of the invention, the evaluation circuit in the function control device, upon the change of one of the binary codes fed to the function selector switch, causes an optical and/or acoustic warning signal to be triggered. This signal can be issued optically by simply making a particular one or all of the indicator fields of the function control device flash. When the position of the function selector switch is changed, the operator's attention is drawn to the fact that this change took place during a stand-by phase of an operation phase of a fully automatic or time controlled mode of operation. The automatic mode of operation is turned off, but the alternatively selectable mode of operation without the time switch control stays blocked. The functions are again started, when a further input for the program or time control directly through the input elements of the function control device takes place, or when the function selector switch has been previously returned to its zero-position, or through an input element of the function control device, whose resetting was deliberately generated.

In accordance with an added feature of the invention, the resetting of the function control device, upon the change of the position of the function selector switch, sets the function control device in an entry mode/entry-ready mode.

In accordance with a further feature of the invention, the change of the rotary switch by one adjustment position causes a value change in a given one of the binary values, in which case only the binary value is fed to the evaluator circuit. In this way, the evaluation circuit can have a simple construction.

In accordance with a concomitant feature of the invention, a characteristic binary value is assigned to special program cycles, such as automatic roasting and self-cleaning. These special function cycles can be provided in ranges at a higher price level. Ranges which cannot be sold at this price level do not offer this possibility, so that a corresponding control path from the function selector switch to the function control device can be omitted.

Other features which are considered as characteristic for the invention are set forth in the appended claims.

Although the invention is illustrated and described herein as embodied in a device for controlling electrical consuming devices in ovens, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, front-elevational view of a front of a range control;

FIG. 2 is a diagrammatic and schematic circuit diagram of a switch configuration;

FIG. 3 is a chart of control paths for the function control device provided by a function selector switch;

Figure 4:
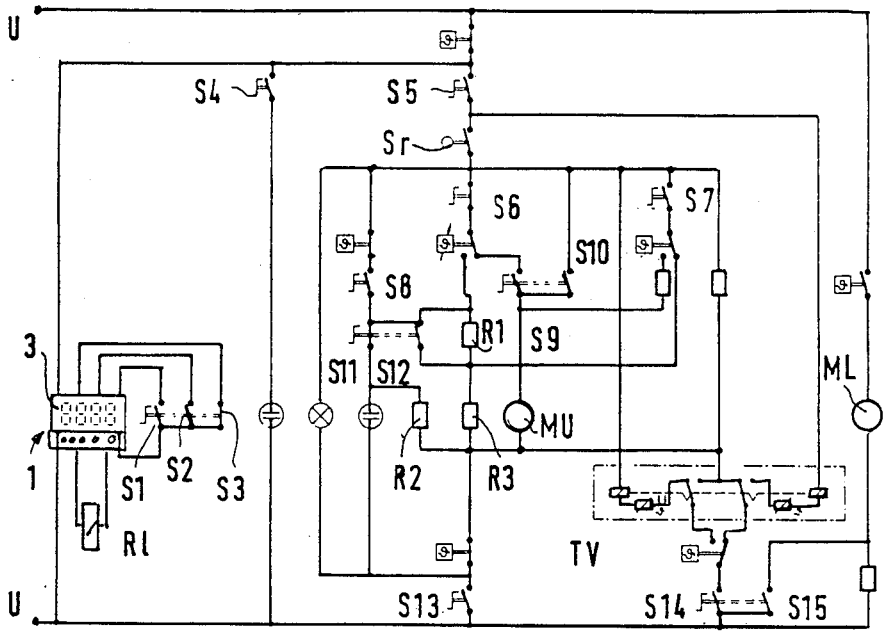
FIG. 4 is a circuit diagram of a range control with an electronic function control device.

Referring now to the figures of the drawings in detail and first, particularly, to FIG. 1 thereof, there is seen a the function control device 1 as well as an assigned function selector switch 2 seen from the operator's side. An indicator display 3 is able to indicate time cycles which influence the function control device, as well as the time of day. Time values can be adjusted through a rotary knob 4, these time values being entered by the simultaneous operation of one of several keys 5, 6, 7, 8. The key 5 is thereby assigned to a short-time-entry. While this key is operated, the function selector switch 2 may be in any position. The time entry through the rotary switch 4 takes place in steps of one minute each. The numeral symbol 1, which is assigned to this key 5, lights up in the indicator display in front of the time values. The time values are shown in hours and minutes. After the release of the key 5, the short-time begins to elapse; after the key 5 is released the time of day appears again in the display. After the short-time is over, a buzzer gives a signal.

The oven can be operated in the modes "flat grill", "air grill", "top/bottom heat" and "circulating air" with, as well as without, utilizing the time control. The symbol assignment can be taken from FIG. 3. If the time control is to be used, the key 8 is to be depressed, and then the assigned symbol is permanently displayed in the indicator display. The symbol numerals for the keys 6 and 7 flash in one-second rhythm. Values for an operating duration and an operating end can then be entered through the rotary switch 4, if the assigned key 6 or 7 is depressed simultaneously. The entered time values are started immediately.

The utilization of the automatic roasting or of the self-cleaning operations is also prepared by means of the key 8. The time for the automatic roasting operation is limited to a one hour minimum, while the self-cleaning is adjusted for three hours. In order to perform the various modes of operation, the function selector switch 2 has to be brought to the necessary adjustment position. This function control switch 2 controls the function control device 1 through contacts S1, S2, S3. Moreover, the function selector switch 2 also adjusts the corresponding heating ranges. The adjustment relative to temperature values and power values takes place through additional entry switches in a known manner.

As can be seen in FIG. 3, the different modes of operation are provided as binary values through the positions of the switches S1, S2, S3. These binary values are fed to the function control device. This depiction shows that the switch S1 emits a typical criterion for the choice whether the mode "automatic roasting" or "self-cleaning" is to be performed. The switch S1 and the corresponding connection can be omitted, if the construction of a range does not provide for these modes of operation. The switch path S3 serves exclusively for signalling whether the function selector switch is in the zero-position or in one of the mode-positions.

As can be seen in the illustration of the function selector switch 2 in FIG. 1, the modes of operation "flat grill". "circulating air", "air-grill" and "top/bottom heat" are assigned adjacent positions of the function selector switch. During deliberate switching between these modes of operation, a selected mode and especially an unselected mode on the function selector switch would, without additional steps in the automatic time operation for these function modes, lead to interference and to dangerous situations. The danger stems from the fact that the adjusted duration is maintained for the corresponding mode of operation as well as when the mode of operation is changed. In order to prevent this, the switch S2 is influenced by the function selector switch through trip stops in accordance with the table shown in FIG. 3. At least when a change occurs between these adjacent functions, a potential change is signaled to the function control device. This turns off the time switch control; at the same time, the indicator fields of the display 3 are caused to flash, so that the operator's attention is drawn to the fact that a new entry into the function control device has to be performed, or that it has to be turned off for the further performance of purely manual operations.

The circuit of the range control has three heating resistors R1, R2, R3, of which R1 and R2 are assigned to the bottom or lower heating for an oven, and R 3 is assigned to broiling or upper heating. A motor MU drives the circulation air ventilator. A further motor ML drives the cooling ventilator for the components. Through the contacts S4 to S15, which are operated by the cams of the function selector switch 2 in its various adjustment positions according to the mode of operation to be performed, the heating resistors R1, R2, and R3, the ventilation motor MU, as well as illumination and display elements can be connected or switched correspondingly. A switching unit TV serves for securing the oven door during the mode "self-cleaning", which must not be interrupted, and during which the oven door must not be opened. The modes "automatic roasting" and "self-cleaning" as well as the time control for the other modes are performed by the function control device 1, which controls the power current of the switching device according to FIG. 4 through the switching contact Sr of the relay R1, which is connected to the function control device.

Figure 5:
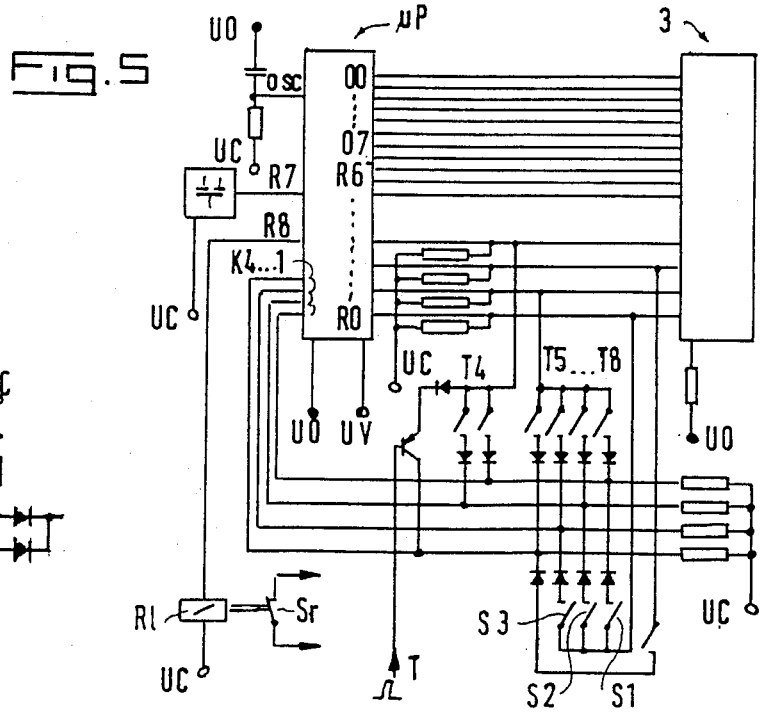
FIG. 5 is a circuit diagram of the function control device.

FIG. 5 shows the principal construotion of the function control device 1, whose central unit is a microprocessor uP (e.g. TMS 1070 by Texas Instruments). The inputs K1, K2, K3, K4 are multiplex connected with the switching contacts T5, T6, T7, T8 of the keys 5, 6, 7, 8 (according to FIG. 1) as well as with the contacts S1, S2, S3 of the function selector switch 2 through the outputs R1, or R0. The microprocessor uP controls a relay R1 through the output R8, the contact Sr of the relay controlling the oven heating and if necessary the ventilation motor. By means of timing through this relay contact Sr, analogous to the energy regulation in stoves, the heating power during the entire adjusted cooking time can also be controlled. For the display of time and operational values as well as operational conditions, a display (e.g. 4 LT-13 by Futaba) is connected through the outputs R0 to R6 and 00 to 07 in a conventional manner. The microprocessor can be adjusted to the modes "automatic roasting" and "self-cleaning" by the switching contacts S1, S2, S3, so that these modes are performed automatically. The other modes of operation do not necessitate the microprocessor control, unless they are to be performed within a given timeframe. In this case, at the same time as the rotary knob 4 is operated, one of the keys T6 or T7 is to be depressed, according to whether the time duration or the end of the time is to be entered. If, during an adjusted time cycle, the function selector switch 2 is changed, then a switching change takes place at the contact S2 in accordance with the pattern in FIG. 3. This switching change is used as a criterion to turn off the time control. The time control has to be adjusted for the new operational condition.

The required current supply device is not shown and described, since it is not essential for the invention and it can be constructed in a generally known manner. Voltages of UO=0V, UC=24 V, UV=8.5 V are necessary for the components which are used and an AC-voltage of 3.5 V symmetrical to the voltage UC is necessary for the anode-heating of the light segments of the display 3. The timing impulse T is generated from the operational AC in a known manner.

Figure 6:
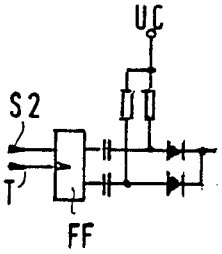
FIG. 6 is an a circuit diagram of an evaluation circuit.

FIG. 6 shows a corresponding time resetting circuit with a flip-flop with differentiator elements on the load side. If a change takes place in the switching position of the switch S2, the flip-flop FF is set or reset, according to the direction of the switching change. The resetting impulse is therefore generated at the corresponding output through the differentiator elements:

I claim:

1. Device for controlling electrical heating resistors in ovens, comprising a function control device for providing timing control of function cycles, a binary coded evaluation circuit connected to the function control device, a manually operated function selector switch for selecting a respective oven function, having binary code switches for controlling the function control device through a binary code connection, manually operated input keys directly assigned to the function control device for entering timing values, the function selector switch further serving for directly setting the connections between the heating resistors, the binary coded evaluation circuit operating to receive binary codes provided by the function selector switch and the manually operated input keys, which upon change of at least one of the binary codes causes a resetting of the timing values.

2. Device according to claim 1, wherein the binary coded evaluation circuit causes an optical and/or acoustic warning signal to be triggered, upon the change of one of the binary codes fed to the function selector switch.

3. Device according to claim 1, wherein the function control device is resettable and is set into an entry mode/entry-ready mode upon the change of the position of the function selector switch.

4. Device according to claim 1, wherein a change of the function selector switch by one adjustment position causes a value change in a given one of the binary codes, and only said given binary code is fed to the binary coded evaluation circuit.

5. Device according to claim 1, including a given binary code which operates to activate a respective program cycle.

6. Device according to claim 1, including a given binary code which operates to activate a respective automatic roasting program cycle.

7. Device according to claim 1, including a given binary code which operates to activate a respective self-cleaning program cycle.

8. Device according to claim 1 including a single relay responsive to said function control device for controlling the on/off timing of said heating resistors.

* * * * *